United States Patent [19]

Ruppe

[11] 4,006,516

[45] Feb. 8, 1977

[54] PROCESS FOR IMPARTING A CRUSHED APPEARANCE TO PILE FABRIC

[75] Inventor: Charles R. Ruppe, Spartanburg, S.C.

[73] Assignee: Deering Milliken Research Corporation, Spartanburg, S.C.

[22] Filed: Oct. 10, 1974

[21] Appl. No.: 513,626

Related U.S. Application Data

[60] Division of Ser. No. 346,679, March 30, 1973, abandoned, which is a continuation of Ser. No. 157,965, June 29, 1971, abandoned.

[52] U.S. Cl. ..... 26/2 R

[51] Int. Cl.[2] ..... D06C 23/04

[58] Field of Search ..... 19/156, 161 R; 26/1, 26/2 R, 69 R; 28/72 P, 72.14, 74 P, 76 P; 162/111, 113, 280; 193/2 C; 223/28, 29; 264/282

[56] References Cited

UNITED STATES PATENTS

| | | | |
|---|---|---|---|
| 1,601,633 | 9/1926 | Lorenz | 162/280 |
| 1,689,037 | 10/1928 | Lorenz | 162/280 |
| 1,978,407 | 10/1934 | Cadgene | 26/1 |
| 2,094,081 | 9/1937 | Platt | 28/72 P UX |
| 2,167,819 | 8/1939 | Welti | 26/69 R |
| 2,230,270 | 2/1941 | Simpson | 19/156 X |
| 2,524,119 | 10/1950 | Van Heck | 26/2 R |
| 2,851,206 | 9/1958 | Guenther et al. | 223/28 |
| 2,878,547 | 3/1959 | McMaster et al. | 28/72.14 X |
| 3,313,005 | 4/1967 | Moon | 19/161 R X |
| 3,390,218 | 6/1968 | Painter et al. | 264/282 |

FOREIGN PATENTS OR APPLICATIONS

| | | | |
|---|---|---|---|
| 37-12046 | 8/1962 | Japan | 223/28 |
| 28,420 | 1897 | United Kingdom | 26/2 R |

*Primary Examiner*—Robert R. Mackey
*Attorney, Agent, or Firm*—Earle R. Marden

[57] ABSTRACT

A continuous process for imparting a crushed appearance to pile fabrics, such as lightweight velvet type fabrics used in upholstery, draperies and the like, wherein the fabrics, in wet form, are continuously accumulated in a mass from a moving length of wet fabric and continuously gravitationally fed to a compression zone where they are compressed to impart a crushed appearance thereto.

1 Claim, 2 Drawing Figures

PROCESS FOR IMPARTING A CRUSHED APPEARANCE TO PILE FABRIC

This is a division of application Ser. No. 346,679, filed Mar. 30, 1973, now abandoned, which is itself a continuation of application Ser. No. 157,965, filed June 29, 1971, also abandoned.

This invention relates to the treatment of textile fabrics and, more particularly, to a process for applying a compressive force to a running length of fabric to change the physical appearance thereof.

It is a general practice to aftertreat certain textile fabrics by the application of mechanical forces to alter their physical appearance. In particular, a substantially permanent crushed appearance can be imparted to lightweight pile fabrics, such as velvet fabrics widely used in upholstery, drapery, wearing apparel, and the like by applying pressure to the upright, surface pile yarns of the fabric to reorient or bend them along their length. In the past, a somewhat random crushed appearance has been imparted by mechanically twisting a length of the pile fabric about its longitudinal axis or by compressing a wadded mass of the fabric, while pattern effects have been produced by passing the fabric through embossing or calendering rolls to selectively crush areas of the pile surface of the fabric in a predetermined pattern.

In randomly crushed pile fabrics, it is desirable that there be no discernable pattern or directional appearance to the crush in the fabric, as is generally the case when the fabric is twisted about its longitudinal axis or is crushed by passing it longitudinally through calendering rolls. Although the above process of compressing a randomly accumulated mass of the fabric in a batch operation reduces the directional appearance of the crush, the process possesses resultant disadvantages of a batch-type operation.

In various fabrics other than pile fabrics, it also is often desirable to provide a random wrinkled appearance in the fabric by the application of mechanical force.

It is therefore an object of the present invention to provide a process for applying a compressive force to a continuously moving length of fabric to impart a random wrinkled or crushed appearance to the fabric. It is a more specific object to provide a process for imparting a substantially permanent random crushed appearance to pile fabrics such as velvets and the like in a continuous manner. It is a further object to provide a process for imparting a random crushed appearance to pile fabrics, and more particularly, continuously to running lengths of the fabrics.

The above as well as other objects of the present invention are accomplished by providing means to apply a compressive force to a moving length of fabric, and means operatively associated therewith for randomly accumulating a mass of the moving fabric and continuously gravitationally feeding the accumulated mass into the compression means. Specifically, there is provided a downwardly tapered hopper positioned generally above a pair of rotatable nip rolls whereby fabrics fed into the open upper end of the hopper are accumulated therein and gravitationally discharged in accumulated form into the nip portion of the rolls to be compressed thereby. The hopper preferably is tapered to provide an accumulation of the fabric in a generally doubly folded manner, i.e., folded both lengthwise and widthwise of the fabric, such that the discharged accumulation is randomly arranged as it is continuously gravitationally discharged into the nip rolls for compression thereby.

The above as well as other objects of the invention will be more apparent and the invention better understood by reference to the accompanying drawings which illustrate one embodiment of the apparatus of the invention, and in which.

Figure 1:
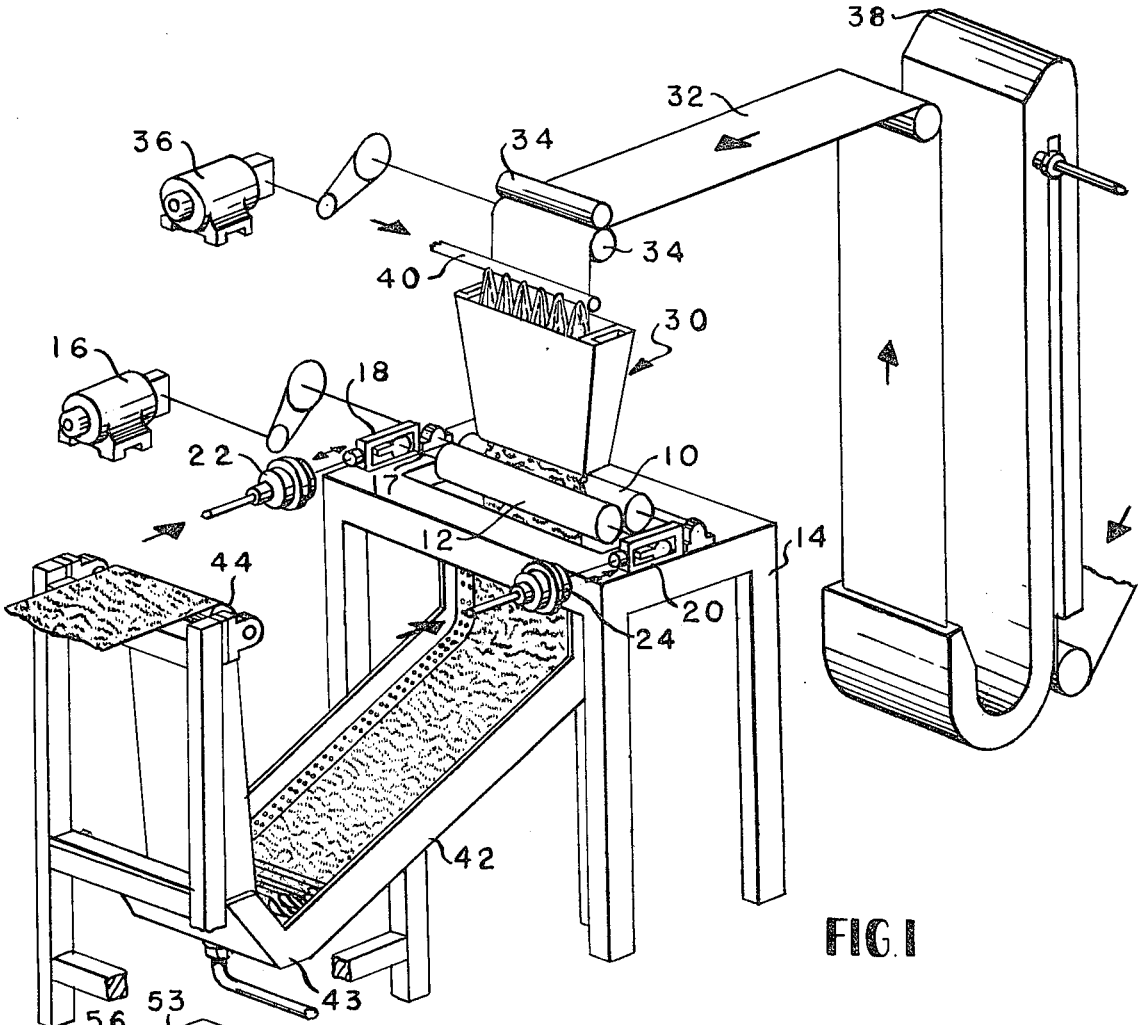
FIG. 1 is a schematic perspective view of the fabric treating apparatus of the present invention.

Referring more particularly to FIG. 1, the fabric treating apparatus comprises nip rolls 10, 12 which may be rubber covered and are rotatably mounted in suitable manner on a frame 14. Nip roll 10 is rotatably driven by an electric motor 16 while the ends of the shaft 17 of freely rotatable roll 12 are slidably mounted in guideways 18, 20 so that the roll 12 is movable toward and away from roll 10. Roll 12 is urged or biased in compressive nip relation with roll 10 by suitable means such as fluid-actuated pistons 22, 24 operatively connected to each end of shaft 17.

Positioned generally above the rotatable nip rolls is a downwardly tapered hopper 30 which serves to accumulate a mass of a moving length of fabric and continuously gravitationally feed the mass into the compression rolls in a manner which will be explained. A length of fabric 32 is continuously fed into the open upper end of the hopper by feed rolls 34 driven by an electric motor 36. The fabric is supplied from a suitable source, not shown, and passes through a J-box 38 where the fabric may be preheated if desired.

A fluid supply pipe 40 positioned above the open end of the hopper 30 provides a treating fluid, such as water and/or steam, to maintain the fabric at elevated temperature and facilitate in its gravitational discharge from the hopper into the compression nip rolls, as will be explained.

Compressed fabric leaving the nip rolls is collected and transported on a perforated scray box 42 which has a trough portion 43 to collect excess liquid removed from the fabric.

The thus treated fabric passes over a guide roll 44 and is collected by suitable means, not shown.

Figure 2:
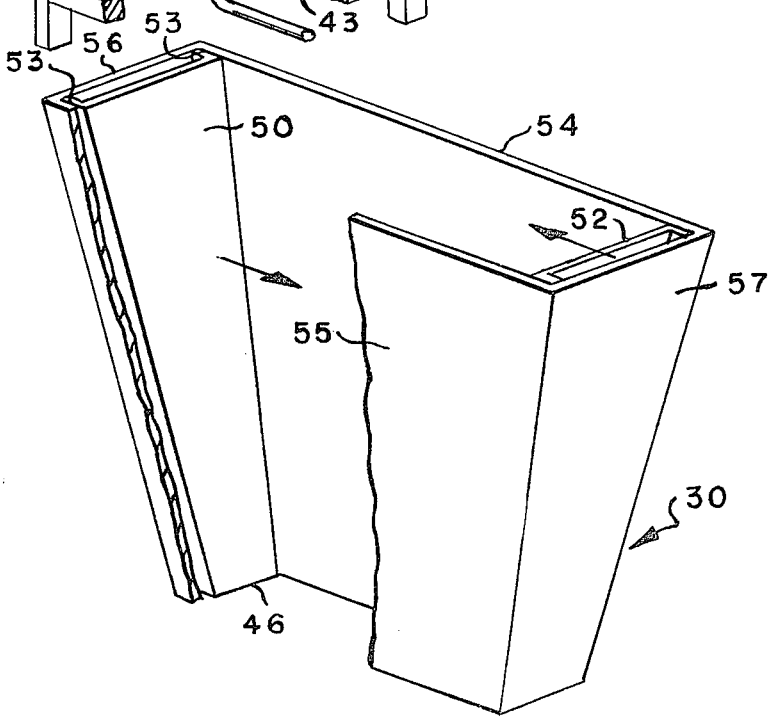
FIG. 2 is an enlarged perspective view of the fabric accumulating hopper of FIG. 1, with a portion broken away for convenience.

As best seen in FIG. 2, the accumulating and feeding hopper 30 has a substantially rectangular cross section with opposed side walls tapering downwardly to form a discharge opening 46 directly above the nip of compression rolls 10, 12. The taper of the hopper may be adjusted by repositioning of side wall insert panels 50, 52 which are frictionally held in position by engagement of their flanged edge portions 53 with opposing side walls 54, 55 of the hopper. Thus by varying the distance and/or the angle of the inserts 50, 52 relative to the side walls 56, 57, the taper and internal dimensions of the hopper may be varied to control the amount of accumulation of fabric in the hopper and its rate of gravitational discharge therefrom.

In operation, when it is desired to employ the apparatus of the present invention to provide a substantially permanent crush to pile fabrics, such as velvets, which are capable of sustaining a substantially permanent crush upon the application of pressure, a moving length of the pile fabric is fed through the J-box 38 where it is preheated to a desired elevated temperature, after which it is fed by a feed roller 34 into the accumulating hopper 30. Preferably the internal dimensions of the hopper are set such that the mass of fabric collecting in the hopper is accumulated in a somewhat double folded manner, i.e., with folds occurring both widthwise and lengthwise of the fabric.

The accumulated fabric in the hopper is treated with hot water and/or steam to maintain the elevated temperature of the fabric and thoroughly wet the pile fabric to facilitate its gravitational feed into the nip rolls and to also facilitate the retention of the crushed appearance in the fabric. As the wet fabric accumulates in the hopper, its weight causes it to be gravitationally discharged from the opening 46 directly into the compression rolls 10, 12. The dimensions of the opening 46 are preferably chosen so that the accumulated mass of fabric is passed into the nip rolls in a somewhat randomly folded arrangement with folds extending both lengthwise and widthwise of the fabric. For permanently crushing pile fabrics exceptionally good crushed appearance is observed in the product when the ratio of the length of the hopper outlet opening to the fabric width is maintained between about 2:3 to 1:2.

A compressive force sufficient to produce a substantially permanent crushed appearance in the pile surface of the fabric is applied to the bunched mass of fabric passing through the nip rolls and the force may be readily adjusted by regulation of the fluid pressure of cylinders or pistons 22, 24 connected to each end of shaft 17 of the movable roll 12. To compensate for variations in the cross-sectional dimensions of the bunched mass of fabric passing between the rolls, movable roll 12 is mounted such that the ends of its shaft 17 are independently positionable in distance from the fixed axis of roll 10.

The compressed and crushed fabric passing from the compression rolls 10, 12 is collected on scray box 42 and excess water removed from the fabric passes through perforations into trough portion 43 for collection. The damp crushed pile fabric is thereafter collected and dried in any suitable manner. The resultant crushed pile fabric, when opened to full width, exhibits a random crushed surface appearance.

It is obvious that pile fabrics of various textile constructions, e.g., flocked, tufted, woven, knitted, may be treated in the present apparatus to impart a crushed appearance thereto. Similarly, various textile fabrics of other than pile type construction may be treated in the apparatus to impart a wrinkled appearance thereto. The fluid treatment of the fabric and the temperature to which it is raised before compression is selected in accordance with the particular type fiber and fabric construction being treated. Exceptional results have been obtained in permanently crushing nylon flocked pile fabric by thoroughly wetting out the fabric with water and crushing the fabric at a temperature of approximately 70° to 80° C. with a compressive force of about 60 pounds per square inch.

The following example illustrates the use of the apparatus of the present invention to impart a substantially permanent crush to a particular pile fabric, and it is given by way of illustration only and is not intended to limit the scope of the present invention.

EXAMPLE

A length of 60 inch wide nylon flocked fabric is prepared in conventional manner by flocking 6 denier DuPont nylon 66 staple fibers of approximately one-tenth inch in length onto an acrylic adhesive-coated woven rayon fabric. After dyeing, a length of the fabric weighing approximately 12 ozs./sq. yard (dry weight) is continuously passed through the J-box 38 where it is treated with hot water and steam to thoroughly wet the fabric and raise the temperature thereof to between 70° and 80° C. The wet preheated fabric leaving J-box 38 is overfed by input rollers 34 into the 36 inches high hopper 30 which is adjusted to have an upper cross-sectional rectangular dimension of 36 by 10 inches and a lower cross-sectional outlet dimension of 24 by 4 inches. Steam and hot water are supplied to the hopper through manifold pipe 40 to maintain the temperature of the fabric therein between 70° and 80° C. and to facilitate the gravitational feed of the wet fabric from the outlet of the hopper into the nip rolls 10, 12. The ratio of the surface speeds of the input rolls 34 to the nip rolls 10, 12 is approximately 2 to 1 and a pressure of approximately 60 p.s.i. is applied to the fabric passing through the rolls. The crushed fabric passing from the rollers is collected on scray 42 while excess water is removed therefrom. The crushed fabric is thereafter padded to remove remaining excess water and tenter frame dried. The resultant flocked pile fabric exhibits a random crushed appearance.

From the foregoing, it can be seen that the apparatus of the present invention may be employed to impart compressive forces, in a continuous manner, to various fabric constructions to impart a highly randomed surface appearance thereto. By utilizing gravitational feed of a randomly bunched or accumulated mass of the fabric into the compression zone of the nip rollers, a highly effective and aesthetically attractive appearance can be created.

That which is claimed is:

1. A process for imparting a crushed appearance to pile fabric comprising the steps of: providing a supply of wet pile fabric capable of retaining a substantially permanent crush upon the application of pressure, continuously overfeeding the supply of wet pile fabric into a confined tapering zone to compress the width of the pile fabric and generally fold the pile fabric in the transverse direction, continuously accumulating the mass of pile fabric into lengthwise and widthwise folds in the confined tapering zone and gravitationally feeding the folded pile fabric from the confined tapering zone into a compressing zone and continuously compressing the pile fabric from the confined zone to impart a crushed appearance thereto.

* * * * *